US012158070B1

(12) United States Patent
Al-Qubaisi et al.

(10) Patent No.: US 12,158,070 B1
(45) Date of Patent: Dec. 3, 2024

(54) REAL TIME ARTIFICIAL INTELLIGENCE PREDICTION OF HYDROGEN SULFIDE BASED ON MUDLOGGING DATA

(71) Applicant: SAUDI ARABIAN OIL COMPANY, Dhahran (SA)

(72) Inventors: Khalid Ali Al-Qubaisi, Dhahran (SA); Yacine Meridji, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/456,409

(22) Filed: Aug. 25, 2023

(51) Int. Cl.

| | |
|---|---|
| ***E21B 49/00*** | (2006.01) |
| ***E21B 21/01*** | (2006.01) |
| ***E21B 44/00*** | (2006.01) |
| ***E21B 45/00*** | (2006.01) |

(52) U.S. Cl.
CPC ..... *E21B 49/005* (2013.01); *E21B 21/01* (2013.01); *E21B 44/00* (2013.01); *E21B 45/00* (2013.01); *E21B 2200/22* (2020.05)

(58) Field of Classification Search
CPC .... E21B 2200/22; E21B 49/005; E21B 44/00; E21B 45/00; E21B 21/01
See application file for complete search history.

(56) References Cited

U.S. PATENT DOCUMENTS

| | | | | |
|---|---|---|---|---|
| 10,025,000 | B2 * | 7/2018 | Monteiro | G01N 33/0044 |
| 10,083,258 | B2 * | 9/2018 | Kauerauf | G01V 20/00 |
| 10,989,048 | B1 * | 4/2021 | Jamison | E21B 49/005 |
| 11,525,935 | B1 | 12/2022 | Camargo et al. | |
| 2006/0032301 | A1 * | 2/2006 | DiFoggio | E21B 49/081 73/152.18 |
| 2014/0158876 | A1 * | 6/2014 | Jones | E21B 41/02 166/250.01 |
| 2023/0017069 | A1 * | 1/2023 | Tan | E21B 43/20 |
| 2024/0018869 | A1 * | 1/2024 | Harrington | G01V 1/50 |
| 2024/0027643 | A1 * | 1/2024 | Yan | G01N 33/2823 |
| 2024/0068355 | A1 * | 2/2024 | Lu | E21B 41/02 |
| 2024/0117737 | A1 * | 4/2024 | Albassam | E21B 44/00 |
| 2024/0141767 | A1 * | 5/2024 | Wang | E21B 43/164 |

OTHER PUBLICATIONS

W. D. Grimes et al., "Prediction of Hydrogen Sulfide and Carbon Dioxide in HPHT Wells", SPE 97568, Sep. 17-19, 2005, pp. 1-6 (6 pages).

E. H. K. Alkamil et al., "Learning from Experience: Using an Unsupervised Learning Real-Time Mud Contamination Monitoring Simulator in Umm Er Radhuma and Tayarat Hydrogen Sulfide Formations", AADE-18-FTCE-SPP-02, Apr. 2018, pp. 1-5 (5 pages).

* cited by examiner

*Primary Examiner* — Shane Bomar
(74) *Attorney, Agent, or Firm* — Osha Bergman Watanabe & Burton LLP

(57) ABSTRACT

A method for determining the real-time concentration of hydrogen sulfide from mudlogging data using artificial intelligence, during a drilling operation, and adjusting drilling operations accordingly. The method includes obtaining mudlogging data while conducting a drilling operation and processing the mudlogging data with an artificial intelligence (AI) model to determine a predicted quantity of hydrogen sulfide. The method further includes determining a drilling operation condition based on the predicted quantity of hydrogen sulfide and adjusting, based on the determined drilling operation condition, the drilling operation. The method further includes determining a completions plan and a production plan for operating a well based on the predicted quantity of hydrogen sulfide.

20 Claims, 10 Drawing Sheets

REAL TIME ARTIFICIAL INTELLIGENCE PREDICTION OF HYDROGEN SULFIDE BASED ON MUDLOGGING DATA

BACKGROUND

In the process of drilling wells for the prospect of hydrocarbons, various naturally occurring subsurface gases are released. These gases may include, for example, carbon dioxide, methane, and hydrogen sulfide. Hydrogen sulfide is particularly dangerous to human health and may provoke death of an exposed individual. Hydrogen sulfide is also corrosive and may damage downhole drilling equipment such as a drill string, drill bit, and downhole sensors (e.g., logging while drilling (LWD tools, measuring while drilling (MWD tools, and guidance and navigation sensors).

For health, safety, and economic reasons, among other things, knowing the real-time concentration of hydrogen sulfide at a drilling site is desirable. Currently, few efforts, if any, exist and/or are employed to determine the concentration of hydrogen sulfide downhole, much less determine from which geological unit(s) the hydrogen sulfide originates, while drilling.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein generally relate to a method for determining the real-time concentration of hydrogen sulfide from mudlogging data using artificial intelligence, while drilling a well, and adjusting drilling operations accordingly. The method includes obtaining mudlogging data while conducting a drilling operation, processing the mudlogging data with an artificial intelligence (AI) model to determine a predicted quantity of hydrogen sulfide and determining a drilling operation condition based on the predicted quantity of hydrogen sulfide. The method further includes adjusting, based on the determined drilling operation condition, the drilling operation, and determining a completions plan and a production plan for operating a well based on the predicted quantity of hydrogen sulfide.

Embodiments disclosed herein generally relate to a system for determining the real-time concentration of hydrogen sulfide from mudlogging data using artificial intelligence, while drilling a well, and adjusting drilling operations accordingly. The system includes a mudlogging system configured to receive mud entrained with gas and cuttings from a wellbore during a drilling operation, including: a gas extractor that separates gas from liquid and solid components of the received mud, a shale shaker that removes the mud cuttings from the received mud, a gas chromatography instrument that determines a chromatogram of the gas separated by the gas extractor, and a computer. The computer includes one or more computer processors, a non-transitory computer-readable medium, and is configured to: receive mudlogging data, process the mudlogging data with an artificial intelligence (AI) model to determine a predicted quantity of hydrogen sulfide, determine a drilling operation condition based on the predicted quantity of hydrogen sulfide, adjust, based on the determined drilling operation condition, the drilling operation and determine a completions plan and a production plan for operating a well based on the predicted quantity of hydrogen sulfide.

Embodiments disclosed herein generally relate to a non-transitory computer-readable memory for determining the real-time concentration of hydrogen sulfide from mudlogging data using artificial intelligence, while drilling a well, and adjusting drilling operations accordingly. The non-transitory computer-readable memory includes computer-executable instructions stored thereon that, when executed on a processor, cause the processor to perform steps including: obtaining mudlogging data while conducting a drilling operation, processing the mudlogging data with an artificial intelligence (AI) model to determine a predicted quantity of hydrogen sulfide and determining a drilling operation condition based on the predicted quantity of hydrogen sulfide. The computer-executable instructions further include adjusting, based on the determined drilling operation condition, the drilling operation and determining a completions plan and a production plan for operating a well based on the predicted quantity of hydrogen sulfide.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1A:
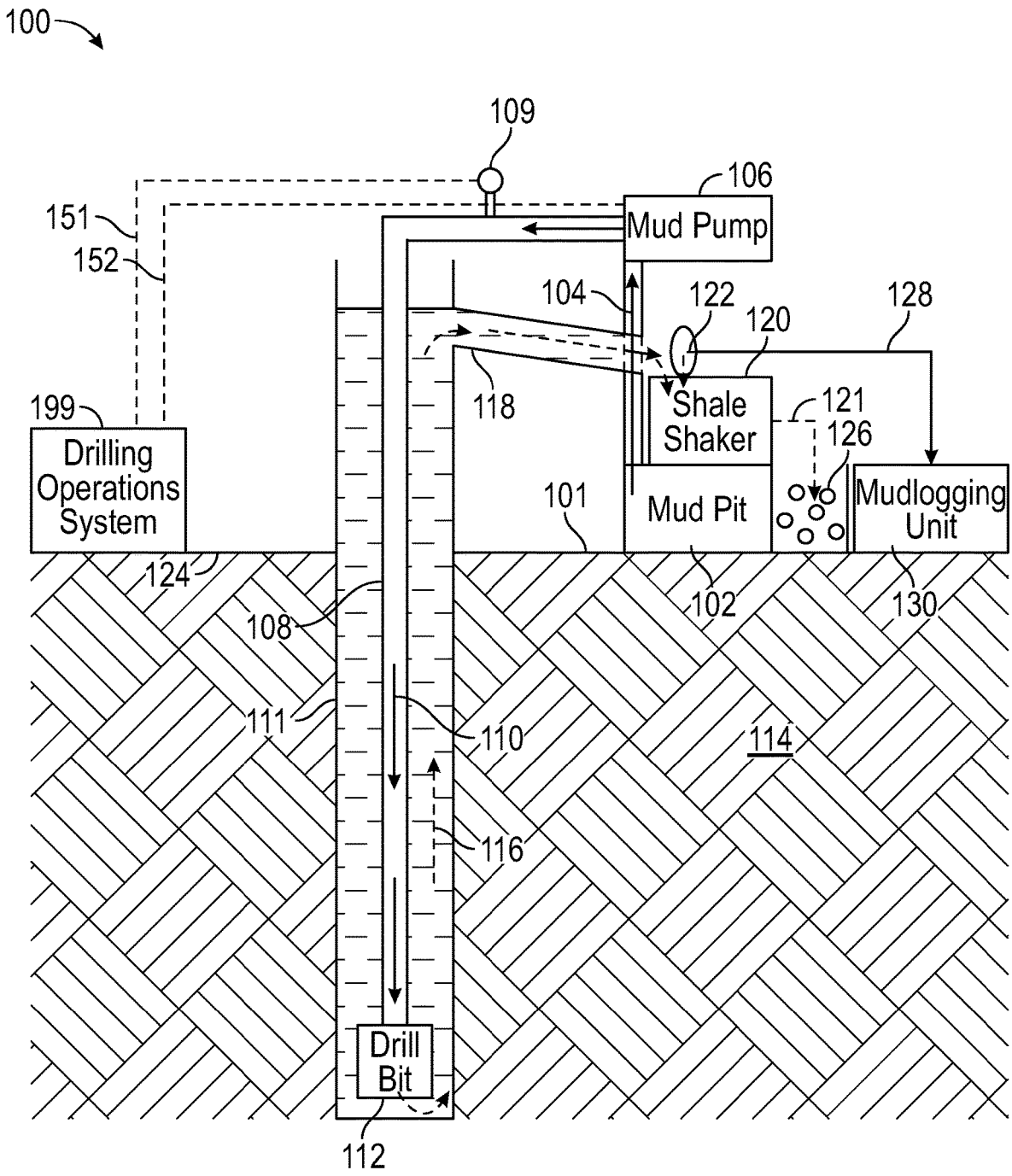
FIG. 1A depicts an example well site in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. For example, a drilling operations sensor may reference two or more such drilling operations sensors.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

In the following description of FIGS. 1-8, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Embodiments disclosed herein generally relate to a hydrogen prediction determination system capable of predicting the concentration of hydrogen sulfide released from subsurface formations as a function of depth in real-time while drilling. Hydrogen sulfide ($H_2S$), along with other gases, may occur naturally in subsurface formations. During activities of oil and gas exploration, drilling, and production, hydrogen sulfide is released from the subsurface and may be entrained with a drilling fluid and/or hydrocarbon production stream brought to the surface of the Earth from a well. Hydrogen sulfide is hazardous to human health and corrosive. As such, hydrogen sulfide released during drilling and production activities poses a threat to human operators (e.g., drilling engineers, gas processing plant operators, etc.) and can damage or destroy sensors, instruments, and equipment associated with the drilling and production activities (e.g., the bottom hole assembly of a drilling system, gas pipelines, etc.). As will be described herein, the hydrogen prediction determination system is capable of predicting a quantity of hydrogen sulfide (e.g., concentration in parts per million (ppm)) while drilling, without the use of dedicated downhole sensors, using mudlogging data. Mudlogging data can include, but is not limited to, characteristics, description and determined properties of a drilling fluid (commonly referred to as "drilling mud" or "mud") returning to the surface after use in a wellbore. Specifically, mudlogging data may be formed by measuring and describing entrained matter, such as drill cuttings ("cuttings") and gas, that surfaces with the mud. For example, analysis of the cuttings may be used to determine or describe the lithology of subsurface while penetrated by a drill bit while drilling forming a lithology descriptor. In one or more embodiments, the mudlogging data includes the lithology descriptor.

FIG. 1A illustrates an example well site (100). A well site (100) may be used to extract oil and gas, generally referred to as hydrocarbons, from underground reservoirs. In general, well sites may be configured in a myriad of ways. Therefore, well site (100) is not intended to be limiting with respect to the particular configuration of the drilling equipment. The well site (100) is depicted as being on land, and the surface of the Earth is denoted as (101). In other examples, the well site (100) may be offshore, and drilling may be carried out with or without use of a marine riser. A drilling operation at well site (100) may include drilling a wellbore (111) into a subsurface (114) including various formations. For the purpose of drilling a new section of wellbore (111), a drill string (108) is suspended within the wellbore (111).

In the depiction of FIG. 1A, a drill bit (112) is disposed at the distal end of the drill string (108). The drill bit (112) cuts into the subsurface rock. The well site (100) may include other drilling tools known in the art but not specifically shown.

Drilling fluid (commonly called "mud") may be stored in a mud pit (102), and at least one mud pump (106) may pump the mud from the mud pit (102) into the drill string (108). The mud may flow into the drill string (108) through appropriate flow paths. Drilling fluid (or mud) is any fluid that is circulated in the wellbore (111) to aid in the drilling operation. Drilling fluids may be broadly categorized according to their principal constituent. For example, a drilling fluid may be said to be an oil-based mud (OBM), water-based mud (WBM), brine-based fluid, or synthetic-based fluid. The base component for a water-based drilling fluid (or WBM) may be fresh water, seawater, brine, saturated brine, or a formate brine. The liquid part of a drilling fluid is known as "mud filtrate." When a drilling fluid passes through a porous medium (e.g., subsurface formation (114)), solid particulates suspended in the drilling fluid may become separated from the mud filtrate. Solid particulates, upon separation, may accumulate and form a layer commonly known as "mudcake." Some well sites (100) may include a drilling fluid processing system (not shown in FIG. 1A). The drilling fluid processing system may include hardware and/or software with functionality for automatically supplying and/or mixing weighting agents, buffering agents, rheological modifiers, and/or other additives to the drilling fluid until it matches and/or satisfies one or more desired drilling fluid properties. In other words, the composition of a drilling fluid may be complex and a drilling fluid may be tailored to a specific well site (100), and, in some instances, the composition of a drilling fluid may be altered in real-time according to the needs of a drilling operation.

In one or more embodiments, one or more sensors (109) may be arranged to measure controllable parameters of the drilling operation. As a non-limiting example, sensors (109) may be arranged to measure: weight on bit (WOB), drill string rotational speed (e.g., rotations per minute (RPM)), flow rate of the mud pumps (e.g., in the units of gallons per minute (GPM)), and rate of penetration of the drilling operation (ROP). In one or more embodiments, the drilling operation may be controlled by the drilling operations system (199). The drilling operations system (199) is configured to receive data from the one or more sensors (109) and control aspects of the drilling operation. That is, the drilling operations system (199) is operatively connected to the one or more sensors (109) and equipment items (e.g., mud pump (106)) of the well site (100). FIG. 1A depicts a first connection (151) connecting the drilling operations system (199) to one of the or more sensors (109) (e.g., a flow rate sensor) and a second connection (152) connecting the drilling operations system (199) to the mud pump (106). In general, other operative connections for the reception of sensor data and the transmission of command signal (as well as other data transmission) are present, however, these other operative connections are not depicted in FIG. 1A to avoid cluttering the figure. The drilling operations system (199) need not be located at the well site (100).

As stated, sensors (109) may be positioned to measure parameter(s) related to the rotation of the drill string (108), parameter(s) related to determining ROP of the drilling operation, and parameter(s) related to flow rate of the mud pump (106). For illustration purposes, only a single sensor (109) is depicted in FIG. 1A proximate the mud pump (106). The illustrated location of sensor (109) is not intended to be limiting, and, in general, one or more sensors (109) could be disposed wherever drilling parameters need to be measured. Moreover, there may be many more sensors (109) than shown in FIG. 1A to measure various other parameters of the drilling operation. Each sensor (109) may be configured to measure a desired physical stimulus.

During a drilling operation at the well site (100), the drill string (108) is rotated relative to the wellbore (111), and weight is applied to the drill bit (112) to enable the drill bit (112) to break rock as the drill string (108) is rotated. In some cases, the drill bit (112) may be rotated independently with a drilling motor. While cutting rock with the drill bit (112), mud is pumped into the drill string (108).

The drilling fluid (i.e., mud) flows down the drill string (108) and exits into the bottom of the wellbore (111) through nozzles in the drill bit (112). Drilling fluid moving through the drill string is depicted with solid arrows (110) in FIG. 1A. The drilling fluid (116) in the wellbore (111) then flows back up to the surface in an annular space between the drill string (108) and the wellbore (111) with entrained cuttings and subsurface gases. Drill cuttings ("cuttings"), in general, are the broken bits of solid material broken by the drill bit (112) while drilling the wellbore (111). Further, as the drill bit (112) penetrates the subsurface formations (114), gases from the subsurface formations may be released and become entrained in the drilling fluid. The drilling fluid returning to the surface after the exiting the drill string (108) is depicted with dashed arrows (116) in FIG. 1A.

At the surface, the returning drilling fluid (116) may contain dissolved gases that are collected from the wellbore (111). Examples of such gases include carbon dioxide, methane and hydrogen sulfide. In one or more embodiments, some of the gases may be separated from the returning drilling fluid (116) by means of a gas extractor (122), then transported to a mudlogging unit (130) through a gas line (128). In the mudlogging unit (130), the gases (i.e., gas mixture) are evaluated. Evaluation may include determining the relative overall quantity (e.g., mass and/or volume) of the gas mixture with respect to the returned drilling fluid and determining the quantity, or concentration, of at least one gas in the gas mixture. The mudlogging unit (130) can be located at any distance from the drilling site.

The entrained cuttings are typically separated from the returning drilling fluid (116) once returned to the surface. In one or more embodiments, the separation of the cuttings from the drilling fluid may be performed by means of a shale shaker (120). In some cases, the cuttings that are separated from the returning drilling fluid (116) may be collected (121) into a container (126). The removed cuttings (and container (126)) can be located at any distance from the drilling site. The separation of the cuttings from the drilling fluids (116) may occur before, after, or at the same time as the separation of the gases from the drilling fluids (116).

After the removal of some of the entrained gases and cuttings (and other possible constituents (e.g., formation water)) from the drilling fluid, the drilling fluid is returned to the mud pit (102) to be circulated back again into the wellbore (111) through the drill string (108). Typically, the drilling fluid is reconditioned as necessary, before pumping the drilling fluid again into the drill string (108).

Depending on the depth of hydrocarbon bearing formation and other geological complexes, a well can have several hole sizes before it reaches its target depth. A steel pipe, or casing (not shown), may be lowered in each hole and a cement slurry may be pumped from the bottom up through the presumably annular space between the casing and the wellbore (111) to fix the casing, seal the wellbore from the surrounding subsurface (114) formations, and ensure proper well integrity throughout the lifecycle of the well. The casing may be inserted periodically while drilling out the well.

Upon finishing drilling the wellbore (111), the well may undergo a "completions" process to stabilize the well and provide reliable access to the desired hydrocarbons. In some implementations, the final wellbore (111) can be completed using either cased and cemented pipe, which is later perforated to access the hydrocarbon, or it may be completed using a multi-stage open-hole packers assembly. Once completed, a well site (100) may be used in production to extract hydrocarbons from underground reservoirs.

Prior to the commencement of drilling, a wellbore plan may be generated. The wellbore plan may include a starting surface location of the wellbore, or a subsurface location within an existing wellbore, from which the wellbore may be drilled.

Typically, the wellbore plan is generated based on best available information at the time of planning from a geophysical model, geomechanical models encapsulating subterranean stress conditions, the trajectory of any existing wellbores (which it may be desirable to avoid), and the existence of other drilling hazards, such as shallow gas pockets, over-pressure zones, and active fault planes. In accordance with one or more embodiments, the wellbore plan may be altered, possibly in real-time, based on a predicted concentration of hydrogen sulfide that is determined while drilling using the hydrogen sulfide determination system described herein.

The wellbore plan may include wellbore geometry information such as wellbore diameter and inclination angle. If casing (not shown in FIG. 1A) is used, the wellbore plan may include casing type or casing depths. Furthermore, the wellbore plan may consider other engineering constraints such as the maximum wellbore curvature ("dog-log") that the drill string (108) may tolerate and the maximum torque and drag values that the drilling system may tolerate.

In many situations, the near-surface is typically made up of loose or soft sediment or rock, so large diameter casing, e.g., "base pipe" or "conductor casing," is often put in place while drilling to stabilize and isolate the wellbore. At the top of the base pipe is the wellhead, which serves to provide pressure control through a series of spools, valves, or adapters. Once near-surface drilling has begun, water or drill fluid may be used to force the base pipe into place using a pumping system until the wellhead is situated just above the surface of the earth.

Due to the high pressures experienced by deep wellbores, a blowout preventer may be installed at the wellhead to protect the rig and environment from unplanned oil or gas releases. As the wellbore becomes deeper, both successively smaller drill bits and casing string may be used. Drilling deviated or horizontal wellbores may require specialized drill bits or drill assemblies.

Figure 1B:
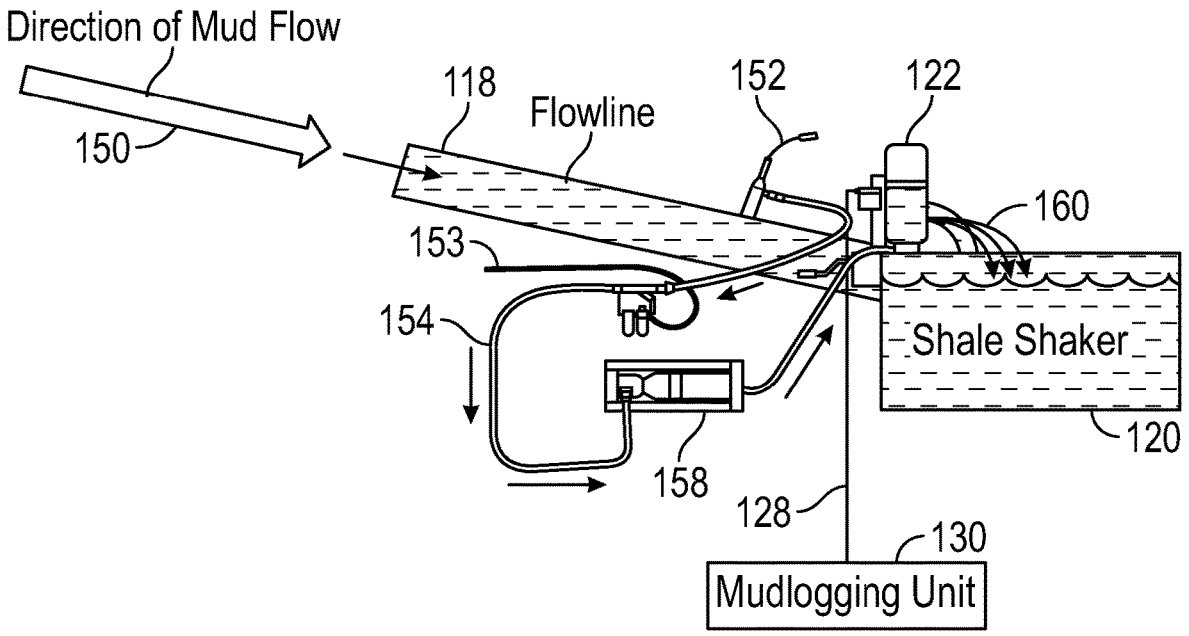
FIG. 1B depicts an example of a gas separation system in accordance with one or more embodiments.

FIG. 1B depicts an example of a gas separation system, that extracts gases from the drilling fluid (116), in accordance with one or more embodiments. In this example, the drilling fluid (116), that returns to the surface, flows through the flowline (118) in a first direction (150) While part of the drilling fluid (116), containing cuttings from the drilling operation, flows directly from the flowline (118) to the shale shaker (120), the other part of the drilling fluid (116) is collected into a sampling device (152) and pumped through a first line (154) where it is mixed with air incoming from a second line (153), resulting in a mud-air mixture. The pumping of the collected mud-air mixture is performed by a first pump (158). The mud-air mixture then flows from the pump (158) into the gas extractor (122). In the gas extractor (122), gases are separated from the mud-air mixture. In one or more embodiments, the gas extractor contains an agitator, which stirs the mud-air mixture with a high number of revolutions per minute, thus increasing the surface of the drilling fluid (116) that is exposed to air. This effect leads to maximizing the mud surface exposed to the air coming from the air inlet and occupies the top of the extraction chamber leading to enhancing the hydrocarbon gas extraction from the mud. In turn, most of the lighter hydrocarbon gas components and some of the heavier hydrocarbon gas components mix with air, resulting in a hydrocarbon gas and air mixture. This hydrocarbon gas and air mixture is then sucked by a suction pump of the analyzer and transported to a mudlogging unit (130) through a third line (128) (gas line) for evaluation. The remainder of the hydrocarbon gases, that do not mix with air, stays in the mud-air mixture, that is released into the shale shaker (120) via a path (160).

Figure 1C:
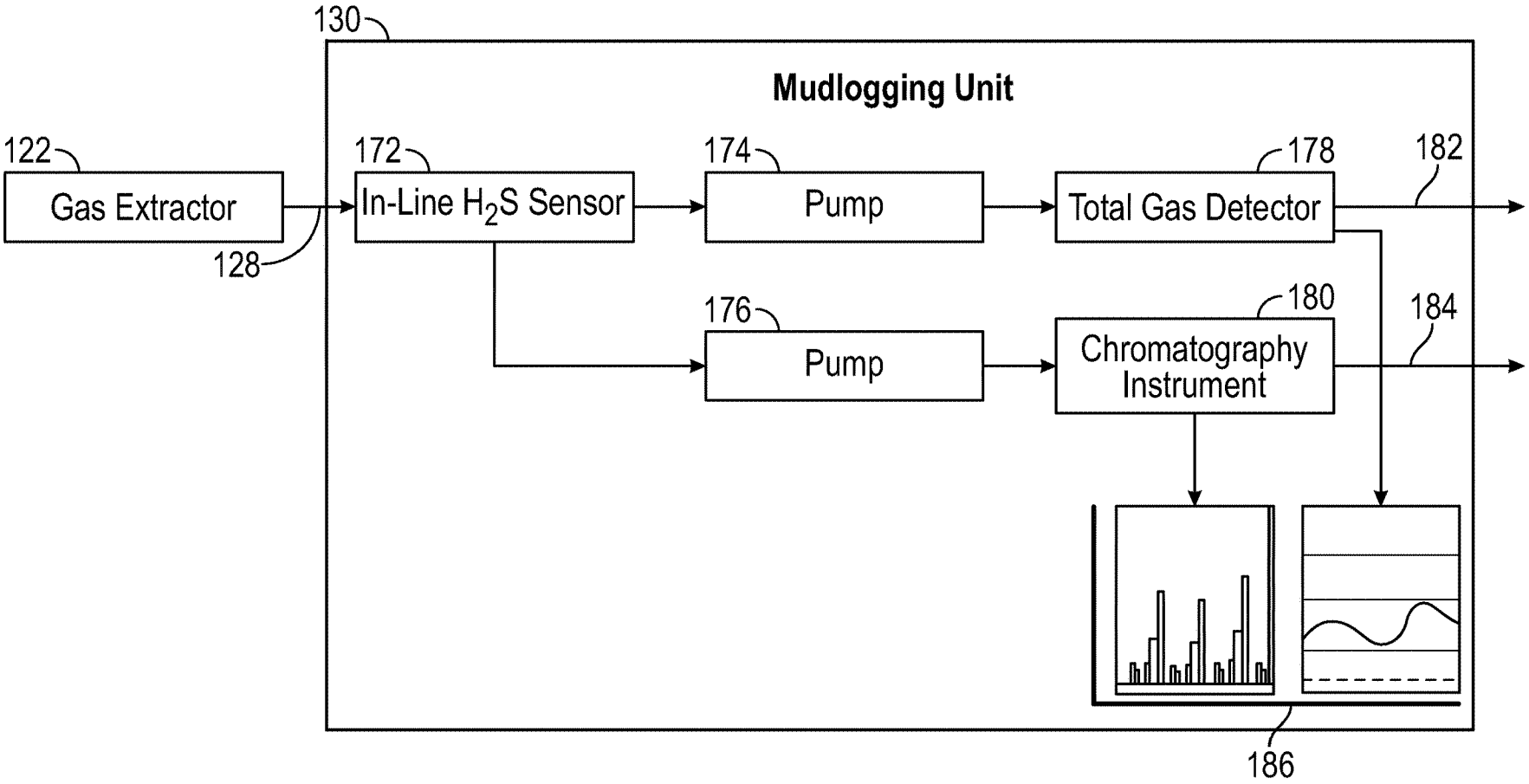
FIG. 1C depicts an example of a mudlogging unit in accordance with one or more embodiments.

FIG. 1C is a schematic representation of an example mudlogging unit (130). In this example, the main components of the mudlogging unit (130) include an in-line hydrogen sulfide sensor (172), a second pump (174), a third pump (176), a total gas detector (178), a chromatography instrument (180) and a recording equipment (186). In this example, the hydrocarbon gas and air mixture coming from the gas extractor (122) enters the mudlogging unit through the third line (128), into the in-line hydrogen sulfide sensor (172). Some of the hydrocarbon gas and air mixture is directed from the in-line hydrogen sulfide sensor (172) to the total gas detector (178) using the second pump (174), where the total quantity of hydrocarbon gases in air is determined, and recorded in the data recording equipment (186). The hydrocarbon gas and air mixture passing through the total detector (178) is released outside of the mudlogging unit (130) through a first vent (182). Some of the hydrocarbon gas and air mixture is directed from the in-line hydrogen sulfide sensor (172) to the chromatography instrument (180) using the third pump (176). The chromatography instrument (180) determines the concentration of each hydrocarbon gas present in the hydrocarbon gas and air mixture, which is recorded in the data recording equipment (186). The hydrocarbon gas and air mixture passing through the chromatography instrument (180) is released outside of the mudlogging unit (130) through a second vent (184).

Figure 2:
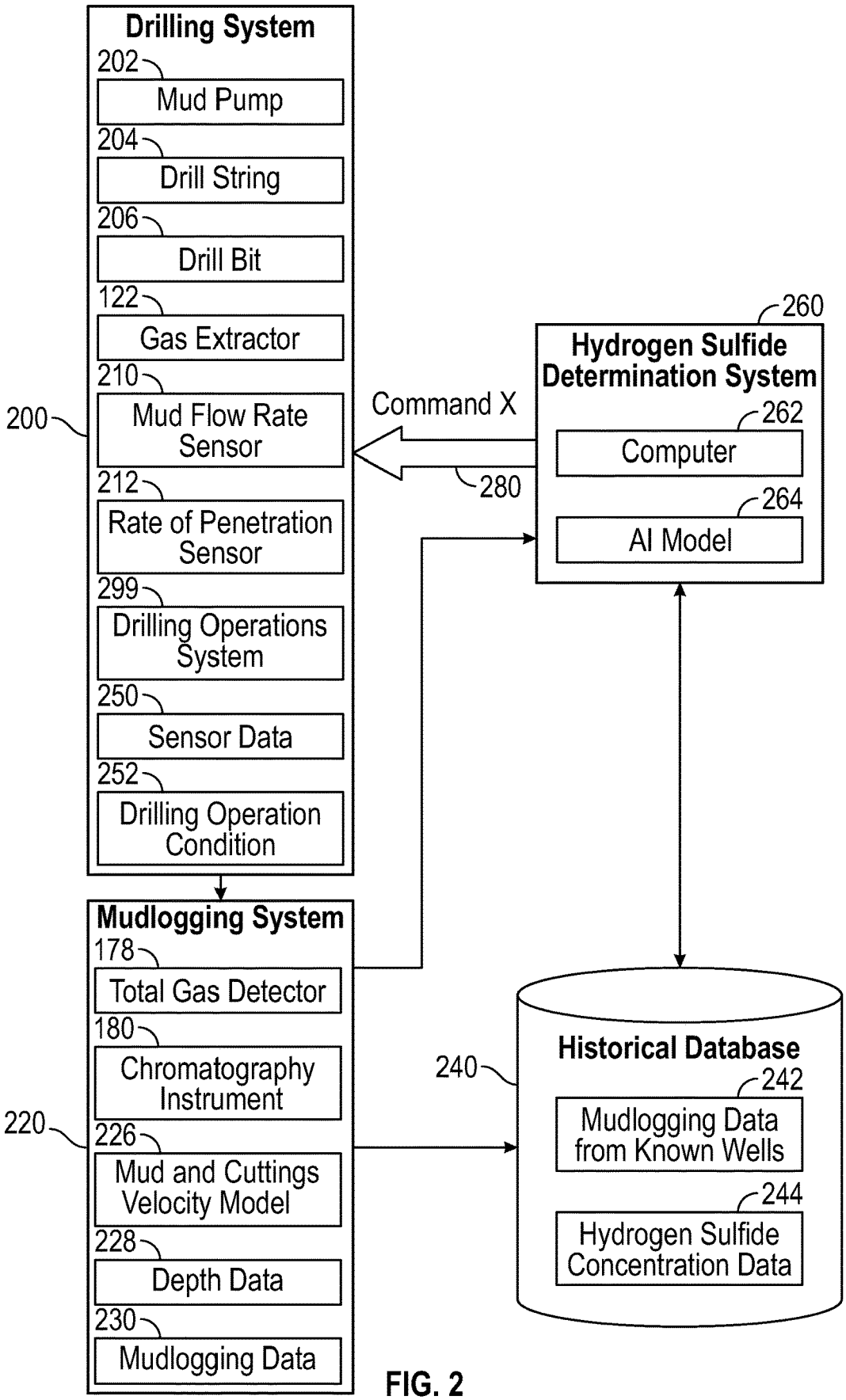
FIG. 2 depicts a block diagram of a hydrogen sulfide determination system in accordance with one or more embodiments.

The block diagram in FIG. 2 depicts a drilling system (200), a mudlogging system (220), a historical database (240) and a hydrogen sulfide determination system (260). In FIG. 2, the hydrogen sulfide determination system (260) is depicted as being comprised of various components, modules, and/or subsystems, where the components, modules, and/or subsystems may interact with each other. Further, in FIG. 2, the hydrogen sulfide determination system (260) is shown to interact with additional surrounding systems. One with ordinary skill in the art will recognize that the partitioning, organization, and interaction of the components, modules, and/or subsystems of the hydrogen determination system (260), alongside interactions with surrounding systems, in FIG. 2 is intended to promote clear discussion and should not be considered fixed or limiting. For example, FIG. 2 depicts a mudlogging system (220) as an independent entity, however, in some embodiments, the mudlogging system (220)—its data and/or its functionality—may be encompassed by the hydrogen sulfide determination system (260). Further, the hydrogen sulfide determination system (260) may store data objects and/or include a database such as the historical database (240).

FIG. 2 depicts, as a block, a drilling system (200). Some elements of the drilling system (200) were discussed, at least in part, in the description of the well site (100) of FIG. 1A. For simplicity, like elements between FIG. 1A and FIG. 2 are renumbered in FIG. 2 to emphasize their relationship to the drilling system (200). The drilling system (200) includes a mud pump (202) that pumps drilling fluid from the surface to the drill bit (206) through a drill string (204). As previously discussed, the drilling fluid exits the drill bit (206) and returns, at least partially, to the surface. The drilling fluid, upon returning to the surface, contains entrained cuttings and subsurface gases. At the surface, gases are separated from the drilling fluid through any suitable process, for example, through use of a gas extractor (122).

In accordance with one or more embodiments, the drilling system (200), as depicted in FIG. 2, further includes one or more mud flow rate sensors (210) that measures the flow rate of the mud. Mud flow rate sensors (210) may be disposed on the drilling system to measure the flow rate of mud entering the drill string (108) and/or returning to the surface from the wellbore (111). In one or more embodiments, the mud flow rate sensors (210) are multiphase flow rate sensors configured to measure the flow rate of multiple constituents and/or phases in the mud. In one more embodiments, at least two individual flow rate sensors are disposed to measure the flow rate of the returning mud after removal of gas and solid constituents and the flow rate of the gas mixture after separation from the mud.

In one or more embodiments, the drilling system (200) further includes a rate of penetration (ROP) sensor (212), that measures or determines the rate at which the drill bit (206) drills into the Earth's subsurface.

Signals (e.g., voltages), measurements, and value acquired by one or more sensors (109) disposed on the drilling system (200) (e.g., mud flow rate sensor (210), rate of penetration sensor (212)) may be collected as sensor data (250) by the drilling system (200). Sensor data (250) may be transmitted to, stored, and used by a drilling operations system (299) of the drilling system (200). As previously described, the drilling operations system (299) is operatively connected to sensors and other equipment (e.g., mud pump (106)) of the drilling system (200). In one or more embodiments, the operation of the drilling system (200) is determined, or at least described by, a drilling operation condition (252). In one or more embodiments, the drilling operation condition (252) is a categorical value, such a "normal," "caution," or "danger." In other embodiments, the drilling operation condition is a quantitative value such as an indication of the current concentration of hydrogen sulfide released while drilling. It is noted that quantitative values may be mapped to categorical values through predefined mappings that associate a given range of a quantitative value with a given class. In some embodiments, the drilling operation condition (252) is an output of a predefined function that acts on, or otherwise weights, various aspects of the drilling operation such as a predicted concentration of hydrogen sulfide and the rate of penetration. In accordance with one or more embodiments, the operation of the drilling system (200) is determined, at least in part, by the drilling operation condition (252). For example, if the drilling operation condition (252) is that of "danger" due to a high predicted concentration of hydrogen sulfide at any point during drilling, the drilling operation may be slowed or stopped until a decision regarding the best practice moving forward can be made by a subject matter expert.

In one or more embodiments, the mudlogging system (220) includes a total gas detector (178). The total gas detector (178) determines the total quantity of gas coming from the gas extractor (122). In one or more embodiments, the mudlogging system (220) further includes a chromatography instrument (180). Chromatography generally refers to the physical separation of a mixture of compounds into its individual constituents. Each constituent of a mixture typically has unique chemical and thermophysical properties. As such, in chromatography, constituents are able to be separated because their unique properties cause them to distribute themselves between two phases: a stationary phase and a mobile phase. In general, a mixture is dissolved in a fluid solvent (i.e., the mobile phase), which may be a liquid or a gas. The mobile phase carries the mixture through an object on which the stationary phase is fixed. Suitable objects may include, but are not limited to, a column, a capillary tube, a plate, and a sheet. The constituents of the mixture tend to have different affinities for the stationary phase (due to their unique properties) and are retained for different lengths of time. As a result, the components travel at different apparent velocities in the mobile fluid causing them to separate. As stated, in chromatography, a mixture is separated into its individual constituents by dissolving the mixture in a mobile phase and passing (e.g., moving, transporting) the mobile phase through a stationary phase. The mobile phase may be a gas or a liquid. Generally, chromatography may further be specified as either "gas chromatography" (GC) or "liquid chromatography" (LC) depending on if the mobile phase is a gas or liquid, respectively.

In one or more embodiments, the gas mixture is processed by the chromatography instrument (180) to determine the relative concentration of at least one constituent gas (e.g., methane). In one or more embodiments, detection and determination of the concentration of at least one constituent gas is performed by the chromatography instrument using a flame ionization detector (FID). Typically, gas constituents separated as part of the chromatography process enter the FID and the FID detects the presence of a constituent and generates an electrical signal proportional to the concentration of the detected constituent. In one or more embodiments, the electrical signal output by the FID is analyzed to produce a chromatogram. In one or more embodiments, the analysis is performed by the chromatography instrument (180). Generally, a chromatogram is a graphical depiction of the constituents detected in a given sample of the gas mixture with an indication of their relative quantity.

In accordance with one or more embodiments, the gas extractor (122) along with the chromatography instrument (180) and total gas detector (178) are used to determine a volume of methane and a normalized total gas measurement of the returning drilling fluid used in a drilling operation.

In one or more embodiments, the mudlogging system produces and includes mudlogging data (230). Mudlogging data (230) may include a description and/or measured properties and characteristics of the returned mud. In one or more embodiments, the mudlogging data (230) includes a measure of the normalized total gas content of returned mud, as measured, for example, using the gas extractor (122). In some embodiments, the mudlogging data (230) further includes a measure of the concentration of methane in the gas mixture separated from the returned mud; acquired, for example, using a chromatography instrument (180).

In one or more embodiments, the cuttings, upon removal from the mud (e.g., using the shale shaker (120)) are evaluated, at least periodically, to determine a lithology descriptor. In general, the lithology descriptor categorizes the cuttings into one or more rock types. For example, in one or more embodiments, the lithology descriptor describes the percent of cuttings belonging to a predefined set of rock types. In one or more embodiments, the predefined set of rock types is {limestone, dolemite, other}, where "other" references any rock type that is not either limestone or dolemite. The evaluation of the cutting to determine a lithology descriptor may be done manually (e.g., by a subject matter expert) using any set of tools known in the art (e.g., microscopy) or may be performed by an automated analysis system (e.g., a computer vision system monitoring the cuttings leaving the shale shaker ((120)). In one or more embodiments, the mudlogging data (230) of the mudlogging system (220) includes the lithology descriptor.

In accordance with one or more embodiments, the mudlogging system (220) further includes a mud and cuttings velocity model (226). The mud and cuttings velocity model (226) is used to compute the velocity of the drilling fluid returning from the wellbore as well as the velocity of the entrained cuttings, where the velocity of the returning drilling fluid and its entrained cuttings need not be the same. In general, the velocity of the cuttings may be referred to as the transport velocity of the cuttings. In one or more embodiments, the mudlogging system (220) uses the mud and cuttings velocity model (226) along with knowledge of the depth history of the drill bit (112) (e.g., computed using the ROP sensor) to determine the depth, or location within the wellbore, from which the returning mud and cuttings originated (or initially exited the drill string (108)). Thus, in one or more embodiments, the mudlogging system (220) includes depth data (228), where the depth data (228) indicates a depth (or position within the wellbore) associated with measured and/or derived quantities determined by the mudlogging system (220) (e.g., volume of methane, normalized gas volume, lithology descriptor, time/depth history of cuttings, etc.). That is, the mudlogging data (230) can be associated with a depth.

FIG. 2 also depicts a historical database (240), in accordance with one or more embodiments. The historical database (240) may include mudlogging data from one or more previously drilled wells (242) as well as a measure of the hydrogen sulfide concentration associated with the mudlogging data of the previously drilled wells (e.g., hydrogen sulfide concentration data ((244)). In one or more embodiments, the hydrogen sulfide concentration data (244) is measured from cased hole drill stem tests or captured samples using a formation tester. Generally, drill stem testing involves a procedure to isolate and stimulate flow in a downhole formation to determine the type, quantity, and possible production rate of fluids from that isolated formation. As such, drill stem testing typically involves deploying a packer or packers (in simplest form, an expanding plug) to isolate sections of a well for testing, a set of valves to control flow through the packer or packers, and any required measuring or testing tool (e.g., thermocouple, pressure transducer, etc.). As such, cased hole drill stem tests or captured sample formation tests are necessarily performed after drilling and cannot provide real-time hydrogen sulfide concentration predictions while drilling. However, the hydrogen sulfide concentration data (244) acquired from such tests, and associated mudlogging data (242) stored in the historical database (240) may be used to train an artificial intelligence (AI) model (264), in accordance with one or more embodiments.

In accordance with one or more embodiments, the hydrogen sulfide determination system (260) makes use of, at least, an AI model (2E64). In one or more embodiments, the hydrogen sulfide determination system (260) may further include a computer (262), on which the AI model (264) is hosted and run. A brief introduction to relevant concepts of artificial intelligence (AI) and a greater description of the AI model (264) are provided later in the instant disclosure. However, for now, it is sufficient to say that the AI model (264) predicts, in real-time or near real-time, a concentration of hydrogen sulfide (i.e., hydrogen sulfide concentration) based on mudlogging data (230) received from the mudlogging system. Further, in one or more embodiments, based on the predicted real-time hydrogen sulfide concentration as determined by the hydrogen sulfide determination system (260), the hydrogen sulfide determination system (260) may adjust operation of the drilling system (200) through one or more command signals (e.g., command X (280) depicted in FIG. 2). For example, the command signal(s) may update the drilling operation condition (252). In one or more embodiments, the hydrogen sulfide determination system (260) further determines a safety condition based on the predicted hydrogen sulfide concentration. In one or more embodiments, decisions regarding the planned wellbore path, as indicated by a wellbore planning system, may be informed and/or adjusted according to the predicted hydrogen sulfide concentration. In some embodiments, a completions plan and/or a production plan may be determined based on the predicted hydrogen sulfide concentration. For example, the type of equipment used downhole to produce hydrocarbons from a reservoir in the subsurface may be selected based on the predicted hydrogen sulfide concentration. Additionally, production plans, such as the use of injection wells, may be altered to optimize hydrocarbon production from the well based on the predicted hydrogen sulfide concentration.

In one or more embodiments, the real-time hydrogen sulfide concentration determined by the hydrogen sulfide determination system (260) is validated through one or more tests after drilling (e.g., cased hole drill stem tests). In instances where the hydrogen sulfide concentration is directly measured using a post-drilling test, the measured hydrogen sulfide values may be appended to the hydrogen sulfide concentration data (244) and the associated mudlogging data (230) may likewise be appended to the mudlogging data from known wells (242) in the historical database (240). In this way, newly acquired data may also be used to train, re-train, or fine tune the AI model (264). Training of the AI model (264) is described in greater detail later in the instant disclosure.

Figure 3:
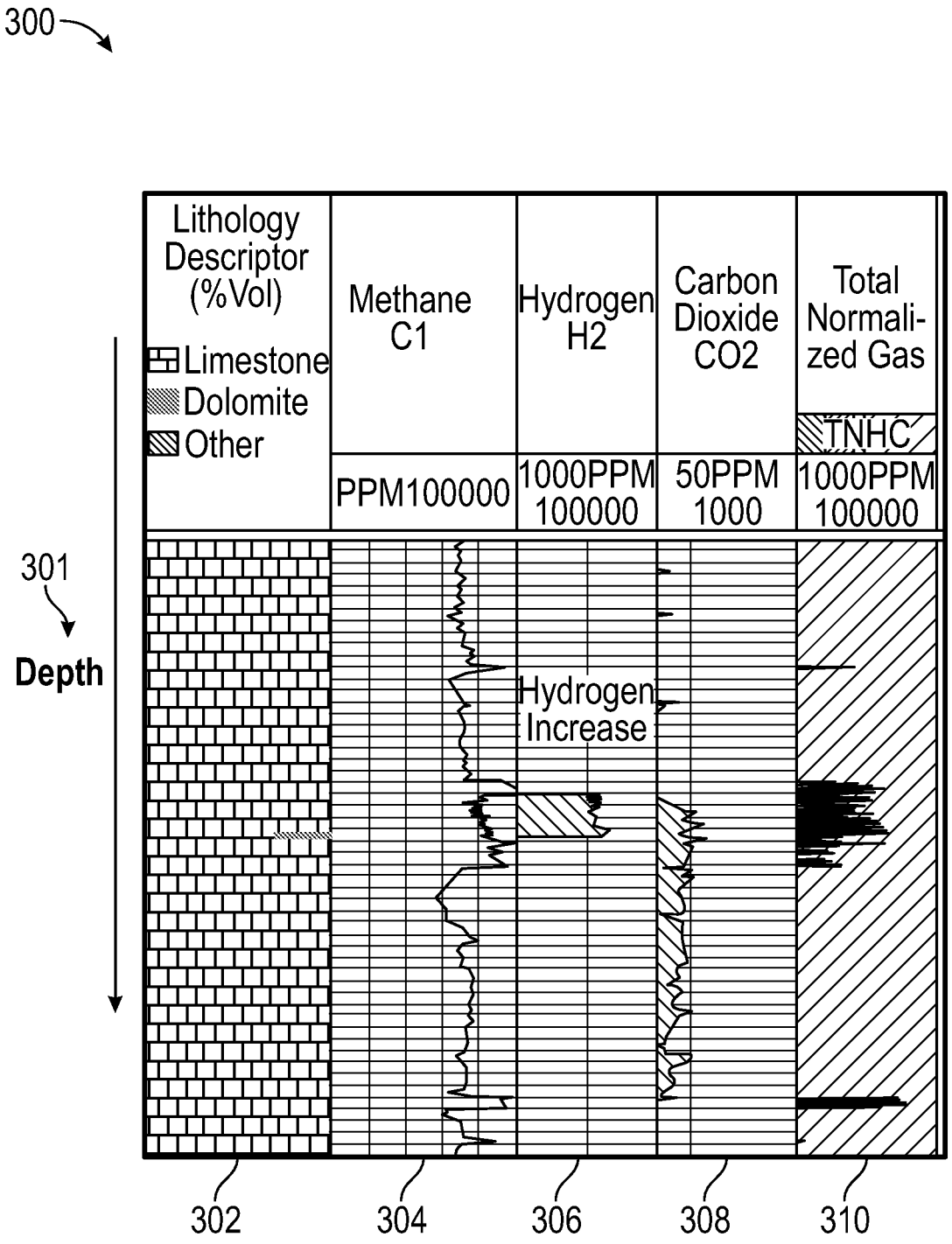
FIG. 3 depicts example mudlogging data in accordance with one or more embodiments.

FIG. 3 depicts an example of mudlogging data (300) acquired while drilling a well, in accordance with one or more embodiments. As stated, a gas mixture entrained in mud returning to the surface during a drilling operation may be separated from the mud. Separation of the gas mixture may be performed by any suitable system, such as a gas extractor (122). In one or more embodiments, concentrations of various constituents of the gas mixture are determined (e.g., using a chromatography instrument (180)). FIG. 3 depicts the measured concentrations (given as ppm) of methane (304), hydrogen (306), and carbon dioxide (308) as a function of depth (301), or distance in non-vertical wells, in the wellbore. The example mudlogging data (300) further indicates the total volume of gas (310) that was separated from the drilling fluid at each depth of the same range. The total volume of gas (310) observed in the graph was normalized. Several normalization techniques exist. In one or more embodiments, a normalization technique may depend on the type of rock drilled, the hydrocarbon formation fluid, the drilling fluid and drilling parameters, such as the rate of penetration (ROP) of the drill bit (112), the drilling fluid flow rate and drilled hole size. An example of normalization technique is given by the formula $$NG = \frac{M * \sum_{i=1}^{n} C_i}{ROP * B^2}, \qquad \text{EQ 1}$$

where NG is the normalized gas concentration, M is the mud flow rate, ROP is the rate of penetration of the drill bit, and B is the size of the drill bit (112). Further, in EQ. 1, each constituent gas in the mixture is indexed with i, for i varying from 1 to n with an increment of 1, where n is the number of constituent gases in the mixture and $C_i$ is the concentration of the $i^{th}$ constituent. For example, if the gas mixture is composed of the three gases, namely, methane, hydrogen, and carbon dioxide, then n=3. Further, methane can be given the index of 1, hydrogen can be given the index of 2, and carbon dioxide can be given the index of 3. Using these indices the concentration of methane is denoted by $C_1$, the concentration of hydrogen is denoted by $C_2$, and the concentration of carbon dioxide is denoted by $C_3$. When applied to EQ. 1, EQ. 1 becomes $$NG = \frac{M * (C_1 + C_2 + C_3)}{ROP * B^2}. \qquad \text{EQ 2}$$

It is noted that the indexing of constituent gases can be applied arbitrarily and is not limited to the indices described above. Finally, the example mudlogging data (300) depicted in FIG. 3 contains a lithology descriptor (302) as a function of depth (301). In the example of FIG. 3, the lithology descriptor (302) indicates the percent volume of cuttings received from each depth (301) that are either a rock type of limestone, dolomite, or other. It is emphasized that the example mudlogging data (300) depicted in FIG. 3 is given only as an example and should be considered non-limiting. One with ordinary skill in the art will recognize that the mudlogging data (230) used by the hydrogen sulfide determination system (260) may omit or contain additional quantities not shown without departing from the scope of this disclosure.

Figure 4:
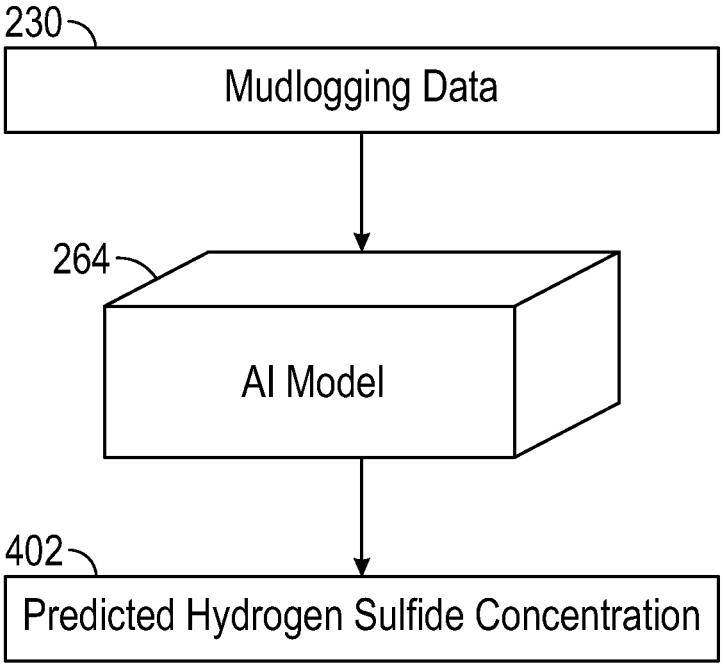
FIG. 4 depicts a system in accordance with one or more embodiments.

FIG. 4 depicts a high-level overview of the AI model (264) in accordance with one or more embodiments. As seen in FIG. 4, in one or more embodiments, mudlogging data (230) acquired while drilling using a mudlogging system (220) is fed into the AI model (264). The AI model (264) processes the mudlogging data (230) and returns a predicted hydrogen sulfide concentration (402). In one or more embodiments, the AI model (264) can operate in real-time, or traceable time, such that a determination of the concentration of hydrogen sulfide, as well as the geological units of the subsurface responsible for its production, can be made while drilling.

In one or more embodiments, the mudlogging data (230) received by the AI model (264) includes the volume of limestone from drill cuttings, volume of dolomite from drill cuttings, volume of methane in a hydrocarbon reservoir detected from surface equipment, and total volume of gas in the reservoir detected from surface equipment. The list of examples of mudlogging data provided in this paragraph are not intended to be exhaustive. Many other mudlogging data may be used.

The AI model (264) in FIG. 4 may take various forms. Examples of AI models include machine learning models. That said, in one or more embodiments, the AI model (264) is a convolutional neural network (CNN).

Artificial intelligence (AI), broadly defined, is the extraction of patterns and insights from data. The phrases "artificial intelligence", "machine learning", "deep learning", and "pattern recognition" are often convoluted, interchanged, and used synonymously throughout the literature. This ambiguity arises because the field of "extracting patterns and insights from data" was developed simultaneously and disjointedly among a number of classical arts like mathematics, statistics, and computer science. For consistency, the term artificial intelligence (AI) is adopted herein. However, one skilled in the art will recognize that the concepts and methods detailed hereafter are not limited by this choice of nomenclature.

AI models (e.g., AI model (264)) model types may include, but are not limited to, generalized linear models, Bayesian regression, random forests, and deep models such as neural networks, convolutional neural networks, and recurrent neural networks. AI model types, whether they are considered deep or not, are usually associated with additional "hyperparameters" which further describe the model. For example, hyperparameters providing further detail about a neural network may include, but are not limited to, the number of layers in the neural network, choice of activation functions, inclusion of batch normalization layers, and regularization strength. Commonly, in the literature, the selection of hyperparameters surrounding an AI model is referred to as selecting the model "architecture." Once an AI model type and hyperparameters have been selected, the AI model is trained to perform a task.

In accordance with one or more embodiments, the AI model type used to predicted a concentration of hydrogen sulfide from mudlogging data while drilling, as described herein, is a convolutional neural network (CNN). A CNN may be more readily understood as a specialized neural network (NN). Thus, a cursory introduction to a NN and a CNN are provided herein. However, it is noted that many variations of a NN and CNN exist. Therefore, one with ordinary skill in the art will recognize that any variation of the NN or CNN (or any other AI model) may be employed without departing from the scope of this disclosure. Further, it is emphasized that the following discussions of a NN and a CNN are basic summaries and should not be considered limiting.

Figure 5:
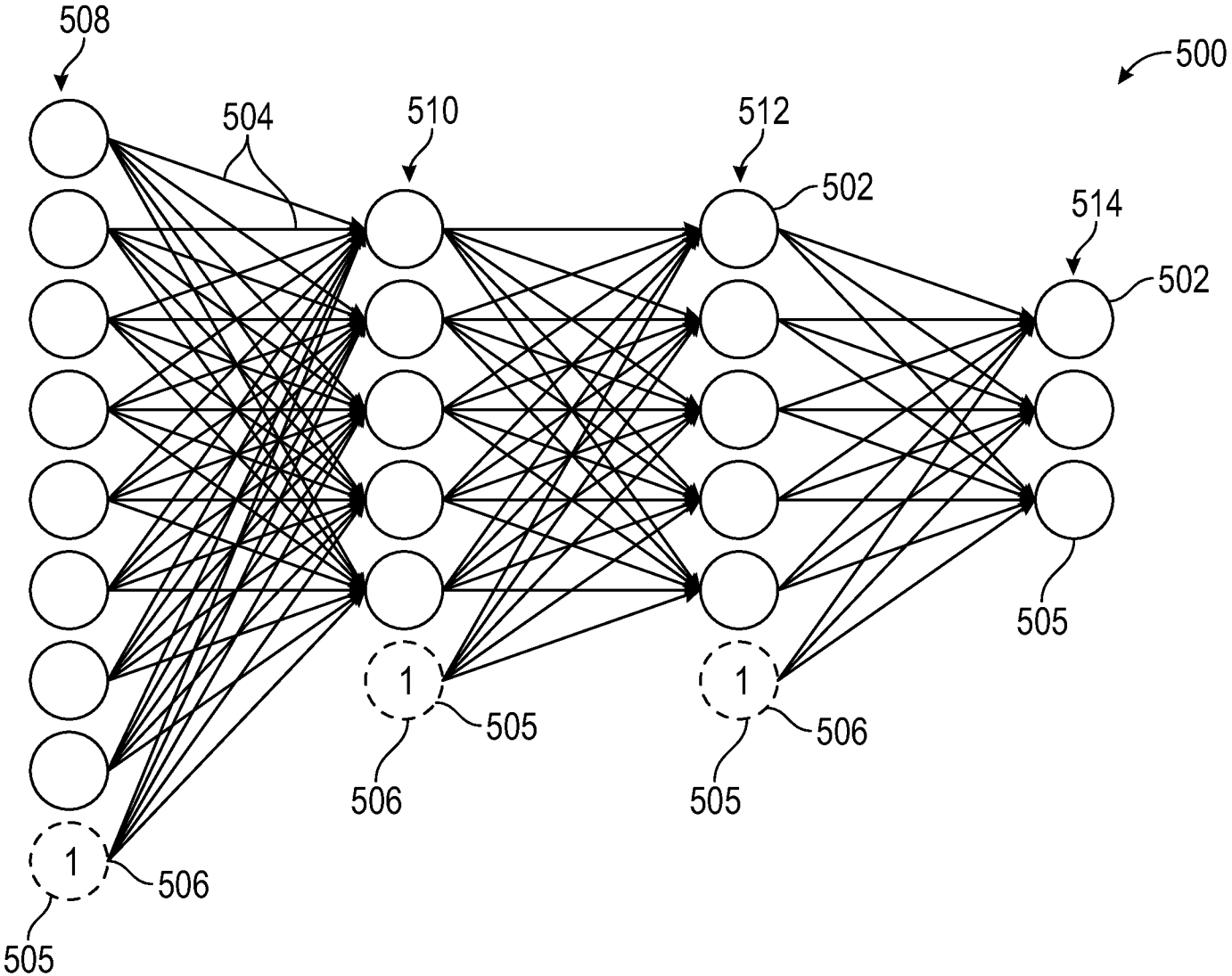
FIG. 5 depicts a neural network in accordance with one or more embodiments.

A diagram of a neural network is shown in FIG. 5. At a high level, a neural network (500) may be graphically depicted as being composed of nodes (502), where here any circle represents a node, and edges (504), shown here as directed lines. The nodes (502) may be grouped to form layers (505). FIG. 5 displays four layers (508, 510, 512, 514) of nodes (502) where the nodes (502) are grouped into columns, however, the grouping need not be as shown in FIG. 5. The edges (504) connect the nodes (502). Edges (504) may connect, or not connect, to any node(s) (502) regardless of which layer (505) the node(s) (502) is in. That is, the nodes (502) may be sparsely and residually connected. A neural network (500) will have at least two layers (505), where the first layer (508) is considered the "input layer" and the last layer (514) is the "output layer." Any intermediate layer (510, 512) is usually described as a "hidden layer." A neural network (500) may have zero or more hidden layers (510, 512) and a neural network (500) with at least one hidden layer (510, 512) may be described as a "deep" neural network or as a "deep learning method." In general, a neural network (500) may have more than one node (502) in the output layer (514). In this case the neural network (500) may be referred to as a "multi-target" or "multi-output" network.

Nodes (502) and edges (504) carry additional associations. Namely, every edge is associated with a numerical value. The edge numerical values, or even the edges (504) themselves, are often referred to as "weights" or "parameters." While training a neural network (500), numerical values are assigned to each edge (504). Additionally, every node (502) is associated with a numerical variable and an activation function. Activation functions are not limited to any functional class, but traditionally follow the form $$A=f(\Sigma_{i\in(incoming)}[(\text{node value})_i(\text{edge value})_i]), \qquad \text{EQ 3}$$

where i is an index that spans the set of "incoming" nodes (502) and edges (504) and $f$ is a user-defined function. Incoming nodes (502) are those that, when the neural network (500) is viewed or depicted as a directed graph (as in FIG. 5), have directed arrows that point to the node (502) where the numerical value is being computed. Some functions for $f$ may include the linear function $f(x)=x$, sigmoid function $$f(x) = \frac{1}{1+e^{-x}},$$

and rectified linear unit function $f(x)=\max(0, x)$, however, many additional functions are commonly employed. Every node (502) in a neural network (500) may have a different associated activation function. Often, as a shorthand, activation functions are described by the function $f$ by which it is composed. That is, an activation function composed of a linear function $f$ may simply be referred to as a linear activation function without undue ambiguity.

When the neural network (500) receives an input, the input is propagated through the network according to the activation functions and incoming node (502) values and edge (504) values to compute a value for each node (502). That is, the numerical value for each node (502) may change for each received input. Occasionally, nodes (502) are assigned fixed numerical values, such as the value of 1, that are not affected by the input or altered according to edge (504) values and activation functions. Fixed nodes (502) are often referred to as "biases" or "bias nodes" (506), displayed in FIG. 5 with a dashed circle.

In some implementations, the neural network (500) may contain specialized layers (505), such as a normalization layer, or additional connection procedures, like concatenation. One skilled in the art will appreciate that these alterations do not exceed the scope of this disclosure.

As noted, the training procedure for the neural network (500) comprises assigning values to the edges (504). To begin training the edges (504) are assigned initial values. These values may be assigned randomly, assigned according to a prescribed distribution, assigned manually, or by some other assignment mechanism. Once edge (504) values have been initialized, the neural network (500) may act as a function, such that it may receive inputs and produce an output. As such, at least one input is propagated through the neural network (500) to produce an output. Training data is provided to the neural network (500). Generally, training data consists of pairs of inputs and associated targets. The targets represent the "ground truth," or the otherwise desired output, upon processing the inputs. In the context of the instant disclosure, an input is mudlogging data (230), or during training, mudlogging data from one or more known wells (242), and its associated target is a known concentration of hydrogen sulfide (i.e., hydrogen sulfide concentration data (244)). Thus, as seen and in accordance with one or more embodiments, training the AI model (264) makes use of the historical database (240). During training, the neural network (500) processes at least one input from the training data and produces at least one output. Each neural network (500) output is compared to its associated input data target. The comparison of the neural network (500) output to the target is typically performed by a so-called "loss function;" although other names for this comparison function such as "error function," "misfit function," and "cost function" are commonly employed. Many types of loss functions are available, such as the mean-squared-error function, however, the general characteristic of a loss function is that the loss function provides a numerical evaluation of the similarity between the neural network (500) output and the associated target. The loss function may also be constructed to impose additional constraints on the values assumed by the edges (504), for example, by adding a penalty term, which may be physics-based, or a regularization term. Generally, the goal of a training procedure is to alter the edge (504) values to promote similarity between the neural network (500) output and associated target over the training data. Thus, the loss function is used to guide changes made to the edge (504) values, typically through a process called "backpropagation."

While a full review of the backpropagation process exceeds the scope of this disclosure, a brief summary is provided. Backpropagation consists of computing the gradient of the loss function over the edge (504) values. The gradient indicates the direction of change in the edge (504) values that results in the greatest change to the loss function. Because the gradient is local to the current edge (504) values, the edge (504) values are typically updated by a "step" in the direction indicated by the gradient. The step size is often referred to as the "learning rate" and need not remain fixed during the training process. Additionally, the step size and direction may be informed by previously seen edge (504) values or previously computed gradients. Such methods for determining the step direction are usually referred to as "momentum" based methods.

Once the edge (504) values have been updated, or altered from their initial values, through a backpropagation step, the neural network (500) will likely produce different outputs. Thus, the procedure of propagating at least one input through the neural network (500), comparing the neural network (500) output with the associated target with a loss function, computing the gradient of the loss function with respect to the edge (504) values, and updating the edge (504) values with a step guided by the gradient, is repeated until a termination criterion is reached. Common termination criteria are: reaching a fixed number of edge (504) updates, otherwise known as an iteration counter; a diminishing learning rate; noting no appreciable change in the loss function between iterations; reaching a specified performance metric as evaluated on the data or a separate hold-out data set. Once the termination criterion is satisfied, and the edge (504) values are no longer intended to be altered, the neural network (500) is said to be "trained."

A CNN is similar to a neural network (500) in that it can technically be graphically represented by a series of edges (504) and nodes (502) grouped to form layers. However, it is more informative to view a CNN as structural groupings of weights; where here the term structural indicates that the weights within a group have a relationship. CNNs are widely applied when the data inputs also have a structural relationship, for example, a spatial relationship where one input is always considered "to the left" of another input. Consequently, a CNN is an intuitive choice for processing mudlogging data.

A structural grouping, or group, of weights is herein referred to as a "filter." The number of weights in a filter is typically much less than the number of inputs. In a CNN, the filters can be thought as "sliding" over, or convolving with, the inputs to form an intermediate output or intermediate representation of the inputs which still possesses a structural relationship. Like unto the neural network (500), the intermediate outputs are often further processed with an activation function. Many filters may be applied to the inputs to form many intermediate representations. Additional filters may be formed to operate on the intermediate representations creating more intermediate representations. This process may be repeated as prescribed by a user. There is a "final" group of intermediate representations, wherein no more filters act on these intermediate representations. In some instances, the structural relationship of the final intermediate representations is ablated; a process known as "flattening." The flattened representation may be passed to a neural network (500) to produce a final output. Note, that in this context, the neural network (500) is still considered part of the CNN. Like unto a neural network (500), a CNN is trained, after initialization of the filter weights, and the edge (504) values of the internal neural network (500), if present, with the backpropagation process in accordance with a loss function.

Returning to FIG. 4, the predicted hydrogen sulfide concentration (402) may be used, for example, to better understand the subsurface (i.e., develop and/or validate subsurface models), to prevent from health issues related to hydrogen sulfide, and to prevent from degradation of equipment due to corrosion by hydrogen sulfide. Accordingly, the predicted hydrogen sulfide concentration (402) may lead to a modification of the drilling operation and/or planned wellbore path.

Those skilled in the art will appreciate that the input data to the AI/CNN is real-time while drilling the well and is populated at every foot and covers several thousands of feet. The H2S measurements are obtained a week or even months after the well is finished at specific depth interval(s). The purpose is to find that specific relationship at that particular depth interval that way in future wells the model knows how predict H2S based on the input data provided at every foot. In one or more embodiments, the training and testing data are split randomly into 70% training and 30% testing and not by well. The H2S is measured across a specific interval where a DST (drill stem test) is performed or a formation sample is obtained, which are usually done later in the life of well. The machine learning model learns the relationship between our inputs (acquired real time) and the H2S % which is found out sometimes months later. For future wells, all that is required is the realtime inputs, as the CNN model has already learned how to predict an estimate what the concentration of H2S should be at any depth.

Figure 6:
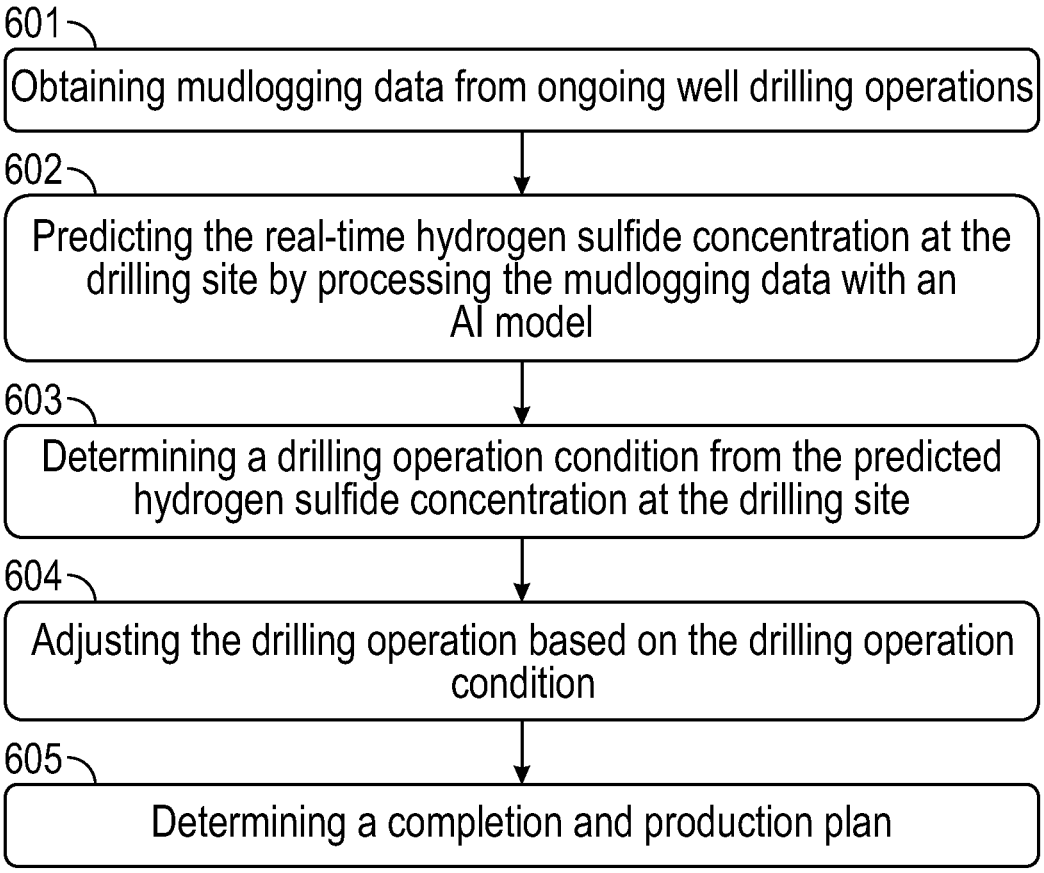
FIG. 6 depicts a flowchart in accordance with one or more embodiments.

The flowchart in FIG. 6 outlines the main steps in the process of determining a completion and production plan for a given drilling operation using hydrogen sulfide concentration determined based on mudlogging data. Initially, in Step 601, mudlogging data from ongoing well drilling operations is obtained. As described in view of FIG. 1A, mudlogging data may be derived from separating entrained gas and cuttings from the drilling fluids returning to the surface after exiting the drill string downhole.

In Step 602, the real-time hydrogen sulfide concentration at the drilling site is determined using an AI model operating on the mudlogging data obtained in Step 601. In one or more embodiments, the AI model is a convolutional neural network.

In Step 603, a drilling operation condition is determined based on the predicted hydrogen sulfide concentration. In one or more embodiments, the operation of the drilling system is determined, or at least described by, the drilling operation condition. In one or more embodiments, the drilling operation condition is a categorical value, such a "normal," "caution," or "danger." In other embodiments, the drilling operation condition is a quantitative value. In one or more embodiments, the drilling operations condition further includes a safety condition that qualitatively or quantitatively indicates a level of hazard caused by produced hydrogen sulfide. The safety condition may be further partitioned based on the activity, facility, and/or personnel. For example, a safety condition may be determined for engineers operating the drilling system and another safety condition may be determined for operators of a gas processing plant.

In Step 604, the drilling operation is adjusted based on, at least in part, the drilling operation condition. For example, if the drilling operation condition is that of "danger" due to a high predicted concentration of hydrogen sulfide at any point during drilling, the drilling operation may be slowed or stopped. In some instances, subsurface models may be updated and the wellbore path may be adjusted according to the predicted concentration of hydrogen sulfide.

Finally, in Step 605, a completions plan and a production plan are determined based on, at least in part, the predicted quantity (directly related to concentration) of hydrogen sulfide. For example, the type of equipment used downhole to produce hydrocarbons from a reservoir in the subsurface may be selected based on the predicted hydrogen sulfide concentration. Additionally, production plans, such as the use of injection wells, may be altered to optimize hydrocarbon production from the well based on the predicted hydrogen sulfide concentration.

It is noted that in one or more embodiments, a mudlogging quantity (e.g., methane concentration) and/or the output quantity (i.e., hydrogen sulfide concentration data) may be transformed prior to training the AI model. Such transformations include, for example, taking a logarithm ($Log_{10}$) of a quantity (e.g., the logarithms ($Log_{10}$) of a gas concentration). Other transformations, such as pre-processing methods such as normalization, may be performed on the mudlogging data and/or the hydrogen sulfide concentration data without limitation. As an example, if the concentration of methane is part of the mudlogging data used as input for training the AI model, the logarithm ($Log_{10}$) of the concentration of methane may be fed as input into the AI model for training. Similarly, the logarithm ($Log_{10}$), or any other transformation, of the concentration of hydrogen sulfide may be used as an associated target to train the AI model. If a transformation is applied on the training data, the same transformation is applied to subsequent data before being processed by the trained AI model.

Figure 7:
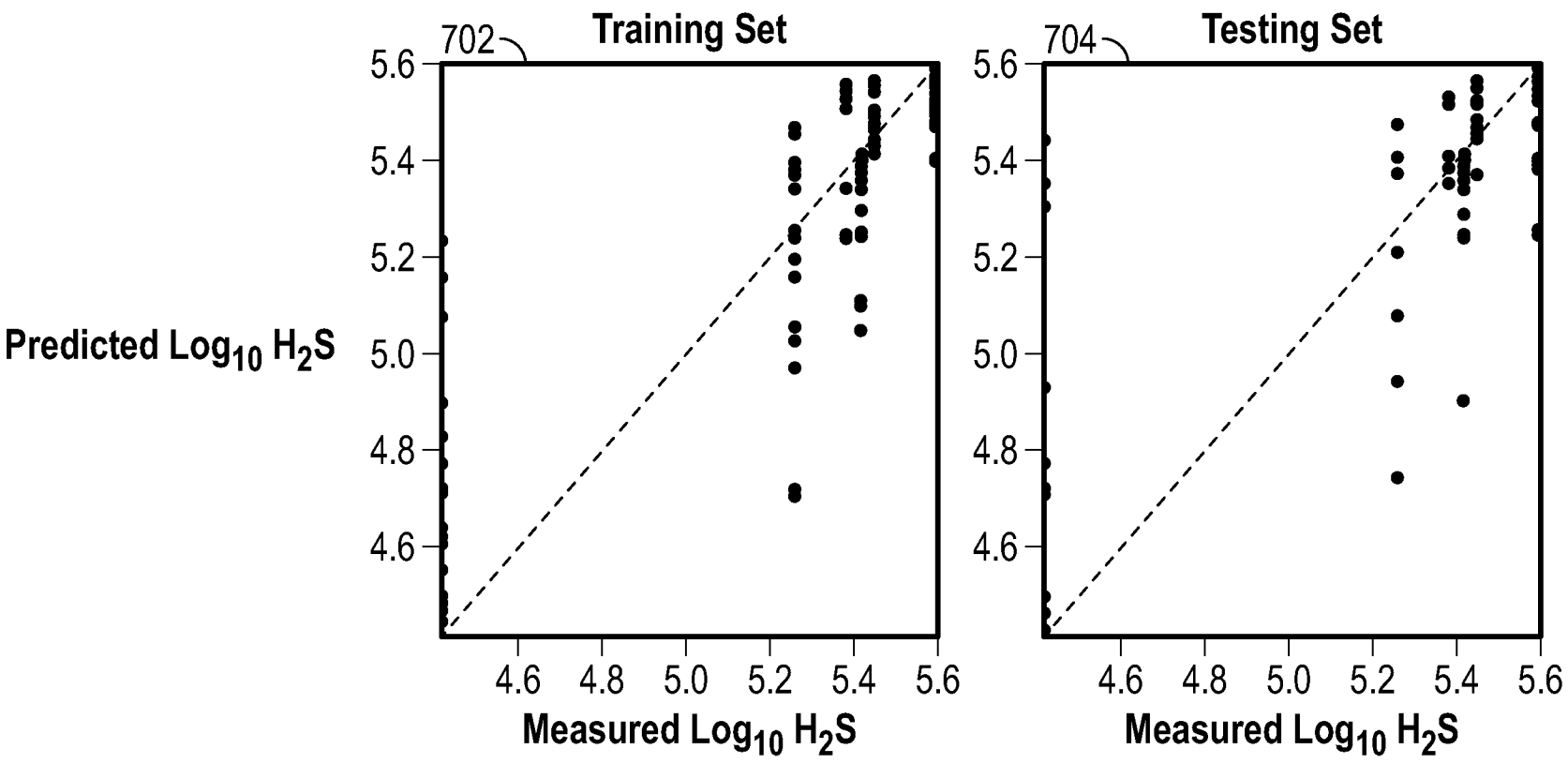
FIG. 7 depicts example parity plots in accordance with one or more embodiments.

FIG. 7 depicts some example results from an AI model trained to predict a logarithm of hydrogen sulfide concentration given mudlogging data. The AI model type associated with the example results of FIG. 7 is a CNN. Historical data, including the measured hydrogen sulfide concentration, is made available for a set of existing wells in order to train the AI model (in this case, a CNN). The set of existing wells and their mudlogging data and associated hydrogen sulfide concentration data is split into two sets, namely, a training set and a testing set.

The training of the CNN is performed using the training set, until the logarithm of the hydrogen sulfide concentrations predicted by the CNN model at the wells that belong to the training set are similar to the measured logarithm of hydrogen sulfide concentrations at the wells that belong to the training set. On the first graph (702) in FIG. 7, each data point compares a predicted logarithm of hydrogen sulfide concentration, as output by the trained CNN, to the known and true logarithm of hydrogen sulfide concentration. If the CNN model performed perfectly, the data points would be located on the dashed line on the graph. An interpretation of the data points being located close to the dashed line is that the logarithm of hydrogen sulfide concentrations predicted by the CNN model are close to the measured logarithm of hydrogen sulfide concentration for the wells in the training set. An example of a measure comparing n predicted values, denoted as $\hat{y}_i$, by a CNN and n true, known values, denoted as $y_i$, for i varying from 1 to n with an increment of 1, is the root mean square error (RMSE), $$RMSE = \sqrt{\frac{1}{n}\sum_{i=1}^{i=n}(\hat{y}i - yi)^2}. \quad \text{EQ 4}$$

In this example, the RMSE for the training set, comparing the predicted logarithm of hydrogen sulfide concentration for the wells in the training set and the known and true logarithm of hydrogen sulfide concentration, was computed to be 0.141204. An interpretation is that such a RMSE for the training set, is low indicating that the logarithm of hydrogen sulfide concentrations predicted by the CNN model is close to the measured logarithm of hydrogen sulfide concentration for the wells in the training set.

Validation of the trained CNN is performed using the testing set and the results are depicted in the second graph (704) in FIG. 7. In the second graph (704) each data point indicates a predicted logarithm of hydrogen sulfide concentration and the known logarithm of hydrogen sulfide concentration. Again, if the CNN model performed perfectly, the data points would be located on the dashed line on the graph. An interpretation of the data points being located close to the dashed line is that the logarithm of hydrogen sulfide concentrations predicted by the CNN model are close to the measured logarithm of hydrogen sulfide concentration for the wells in the testing set. In this example, the RMSE for the testing set, comparing the predicted logarithm of hydrogen sulfide concentration for the wells in the testing set and the known and true logarithm of hydrogen sulfide concentration, was computed to be 0.211185. An interpretation is that such a RMSE for the testing set is low indicating that the logarithm of hydrogen sulfide concentrations predicted by the CNN model is close to the measured logarithm of hydrogen sulfide concentration for the wells in the testing set. According to one of more embodiments, the fact that the RMSE for the training set and the RMSE for the testing set are similar indicates that the trained CNN may predict a future logarithm of hydrogen sulfide concentration accurately, for a well for which the true value of the hydrogen sulfide concentration is unknown.

Figure 8:
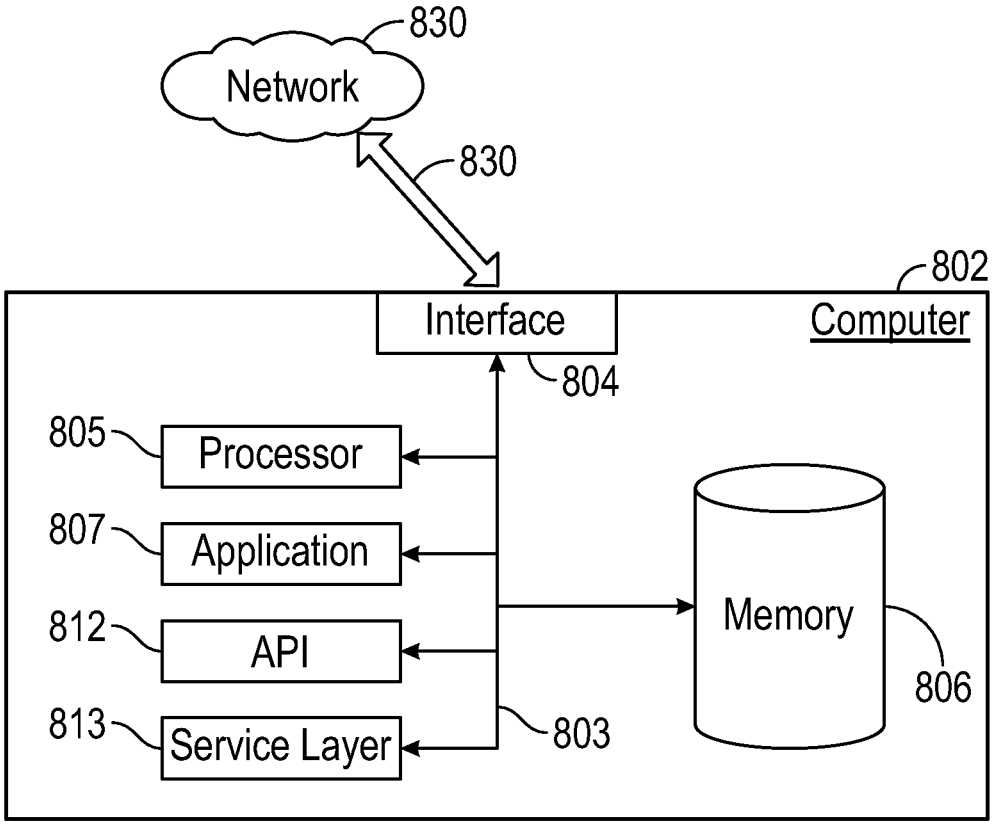
FIG. 8 depicts a system in accordance with one or more embodiments.

FIG. 8 further depicts a block diagram of a computer system (802) used to provide computational functionalities associated with described algorithms, methods, functions, processes, flows, and procedures as described in this disclosure, according to one or more embodiments. The illustrated computer (802) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (802) may include a computer that includes an input device, such as a keypad, keyboard, touch screen, or other device that can accept user information, and an output device that conveys information associated with the operation of the computer (802), including digital data, visual, or audio information (or a combination of information), or a GUI.

The computer (802) can serve in a role as a client, network component, a server, a database or other persistency, or any other component (or a combination of roles) of a computer system for performing the subject matter described in the instant disclosure. In some implementations, one or more components of the computer (802) may be configured to operate within environments, including cloud-computing-based, local, global, or other environment (or a combination of environments).

At a high level, the computer (802) is an electronic computing device operable to receive, transmit, process, store, or manage data and information associated with the described subject matter. According to some implementations, the computer (802) may also include or be communicably coupled with an application server, e-mail server, web server, caching server, streaming data server, business intelligence (BI) server, or other server (or a combination of servers).

The computer (802) can receive requests over network (830) from a client application (for example, executing on another computer (802) and responding to the received requests by processing the said requests in an appropriate software application. In addition, requests may also be sent to the computer (802) from internal users (for example, from a command console or by other appropriate access method), external or third-parties, other automated applications, as well as any other appropriate entities, individuals, systems, or computers.

Each of the components of the computer (802) can communicate using a system bus (803). In some implementations, any or all of the components of the computer (802), both hardware or software (or a combination of hardware and software), may interface with each other or the interface (804) (or a combination of both) over the system bus (803) using an application programming interface (API) (812) or a service layer (813) (or a combination of the API (812) and service layer (813). The API (812) may include specifications for routines, data structures, and object classes. The API (812) may be either computer-language independent or dependent and refer to a complete interface, a single function, or even a set of APIs. The service layer (813) provides software services to the computer (802) or other components (whether or not illustrated) that are communicably coupled to the computer (802). The functionality of the computer (802) may be accessible for all service consumers using this service layer. Software services, such as those provided by the service layer (813), provide reusable, defined business functionalities through a defined interface. For example, the interface may be software written in JAVA, C++, or other suitable language providing data in extensible markup language (XML) format or another suitable format. While illustrated as an integrated component of the computer (802), alternative implementations may illustrate the API (812) or the service layer (813) as stand-alone components in relation to other components of the computer (802) or other components (whether or not illustrated) that are communicably coupled to the computer (802). Moreover, any or all parts of the API (812) or the service layer (813) may be implemented as child or sub-modules of another software module, enterprise application, or hardware module without departing from the scope of this disclosure.

The computer (802) includes an interface (804). Although illustrated as a single interface (804) in FIG. 8, two or more interfaces (804) may be used according to particular needs, desires, or particular implementations of the computer (802). The interface (804) is used by the computer (802) for communicating with other systems in a distributed environment that are connected to the network (830). Generally, the interface (804) includes logic encoded in software or hardware (or a combination of software and hardware) and operable to communicate with the network (830). More specifically, the interface (804) may include software supporting one or more communication protocols associated with communications such that the network (830) or interface's hardware is operable to communicate physical signals within and outside of the illustrated computer (802).

The computer (802) includes at least one computer processor (805). Although illustrated as a single computer processor (805) in FIG. 8, two or more processors may be used according to particular needs, desires, or particular implementations of the computer (802). Generally, the computer processor (805) executes instructions and manipulates data to perform the operations of the computer (802) and any algorithms, methods, functions, processes, flows, and procedures as described in the instant disclosure.

The computer (802) also includes a memory (806) that holds data for the computer (802) or other components (or a combination of both) that can be connected to the network (830). The memory may be a non-transitory computer readable medium. For example, memory (806) can be a database storing data consistent with this disclosure. Although illustrated as a single memory (806) in FIG. 8, two or more memories may be used according to particular needs, desires, or particular implementations of the computer (802) and the described functionality. While memory (806) is illustrated as an integral component of the computer (802), in alternative implementations, memory (806) can be external to the computer (802).

The application (807) is an algorithmic software engine providing functionality according to particular needs, desires, or particular implementations of the computer (802), particularly with respect to functionality described in this disclosure. For example, application (807) can serve as one or more components, modules, applications, etc. Further, although illustrated as a single application (807), the application (807) may be implemented as multiple applications (807) on the computer (802). In addition, although illustrated as integral to the computer (802), in alternative implementations, the application (807) can be external to the computer (802).

There may be any number of computers (802) associated with, or external to, a computer system containing computer (802), wherein each computer (802) communicates over network (830). Further, the term "client," "user," and other appropriate terminology may be used interchangeably as appropriate without departing from the scope of this disclosure. Moreover, this disclosure contemplates that many users may use one computer (802), or that one user may use multiple computers (802).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method, comprising:

obtaining mudlogging data while conducting a drilling operation;

processing the mudlogging data with an artificial intelligence (AI) model to determine a predicted quantity of hydrogen sulfide;

determining a drilling operation condition based on the predicted quantity of hydrogen sulfide;

adjusting, based on the determined drilling operation condition, the drilling operation; and determining a completions plan and a production plan for operating a well based on the predicted quantity of hydrogen sulfide.

2. The method of claim 1, further comprising:

receiving drilling operations data, comprising:

a rate of penetration of a drill bit during the drilling operation, and a mud pump rate during the drilling operation, determining a transport velocity of cuttings received at a surface throughout the drilling operation; and determining a depth corresponding to the mudlogging data based on the drilling operations data and the transport velocity of the cuttings.

3. The method of claim 1, wherein the mudlogging data comprises:

a lithology descriptor;

a total gas measurement; and a methane gas measurement.

4. The method of claim 1, wherein the AI model is a convolutional neural network.

5. The method of claim 3, wherein the lithology descriptor comprises:

a volume of limestone cuttings; and a volume of dolomite cuttings.

6. A system, comprising:

a mudlogging system configured to receive mud entrained with gas and cuttings from a wellbore during a drilling operation, comprising:

a gas extractor that separates gas from liquid and solid components of the received mud, a shale shaker that removes the mud cuttings from the received mud, a gas chromatography instrument that determines a chromatogram of the gas separated by the gas extractor, and a computer comprising one or more computer processors and a non-transitory computer-readable medium, the computer configured to:

receive mudlogging data;

process the mudlogging data with an artificial intelligence (AI) model to determine a predicted quantity of hydrogen sulfide;

determine a drilling operation condition based on the predicted quantity of hydrogen sulfide;

adjust, based on the determined drilling operation condition, the drilling operation; and determine a completions plan and a production plan for operating a well based on the predicted quantity of hydrogen sulfide.

7. The system of claim 6, further comprising:

a drilling system, comprising:

a drill bit disposed at a distal end of a drill string, wherein the drill string is suspended into the wellbore and the drill bit cuts a subsurface forming the cuttings, a mud pit, a mud pump that pumps mud from the mud pit into the wellbore through the drill string, wherein the mud returns to a drilling floor of the drilling system entrained with the gas and cuttings and is received by the mudlogging system, at least one drilling operations sensor, and a drilling control system configured to receive sensor data from the drilling operations sensor and control the drilling operation.

8. The system of claim 7, wherein the computer is further configured to:

receive drilling operations data from the at least one drilling operations sensor, comprising:

a rate of penetration of the drill bit during the drilling operation, and a mud pump rate during the drilling operation, determine a transport velocity of the cuttings; and determining a depth corresponding to the mudlogging data based on the drilling operations data and the transport velocity of the cuttings.

9. The system of claim 6, wherein the mudlogging data comprises:

a lithology descriptor;

a total gas measurement; and a methane gas measurement.

10. The system of claim 6, wherein the AI model is a convolutional neural network.

11. The system of claim 9, wherein the lithology descriptor comprises:

a volume of limestone cuttings; and a volume of dolomite cuttings.

12. The system of claim 9, wherein the lithology descriptor is determined by the computer, wherein the computer is further configured to analyze the cuttings removed from the received mud by the shale shaker.

13. The system of claim 9, wherein the lithology descriptor is received from a subject matter expert upon inspecting the cuttings removed from the received mud by the shale shaker.

14. The system of claim 9, wherein the total gas measurement and the methane gas measurement are determined by the computer based on the chromatogram.

15. A non-transitory computer-readable memory comprising computer-executable instructions stored thereon that, when executed on a processor, cause the processor to perform steps comprising:

obtaining mudlogging data while conducting a drilling operation;

processing the mudlogging data with an artificial intelligence (AI) model to determine a predicted quantity of hydrogen sulfide;

determining a drilling operation condition based on the predicted quantity of hydrogen sulfide;

adjusting, based on the determined drilling operation condition, the drilling operation; and determining a completions plan and a production plan for operating a well based on the predicted quantity of hydrogen sulfide.

16. The non-transitory computer-readable memory of claim 15, the steps further comprising:

receiving drilling operations data, comprising:

a rate of penetration of a drill bit during the drilling operation, and a mud pump rate during the drilling operation, determining a transport velocity of cuttings received at a surface throughout the drilling operation; and determining a depth corresponding to the mudlogging data based on the drilling operations data and the transport velocity of the cuttings.

17. The non-transitory computer-readable memory of claim 15, wherein the mudlogging data comprises:

a lithology descriptor;

a total gas measurement; and a methane gas measurement.

18. The non-transitory computer-readable memory of claim 15, wherein the AI model is a convolutional neural network.

19. The non-transitory computer-readable memory of claim 17, wherein the lithology descriptor comprises:

a volume of limestone cuttings; and a volume of dolomite cuttings.

20. The non-transitory computer-readable memory of claim 17, wherein the total gas measurement and the methane gas measurement are determined using a gas extractor and a gas chromatography instrument.

* * * * *